US008177443B2

(12) United States Patent
Malone et al.

(10) Patent No.: US 8,177,443 B2
(45) Date of Patent: May 15, 2012

(54) HANDHELD PATTERN CREATING DEVICE AND METHOD OF USE OF SAME

(75) Inventors: Josh Malone, Plano, TX (US); Michael Wuensch, Farmers Branch, TX (US)

(73) Assignee: Tinnus Technology, LLC, Plano, TX (US)

( * ) Notice: Subject to any disclaimer, the term of this patent is extended or adjusted under 35 U.S.C. 154(b) by 1182 days.

(21) Appl. No.: 11/845,695

(22) Filed: Aug. 27, 2007

(65) Prior Publication Data

US 2008/0050163 A1 Feb. 28, 2008

Related U.S. Application Data

(60) Provisional application No. 60/840,387, filed on Aug. 25, 2006.

(51) Int. Cl.
*B43L 13/00* (2006.01)

(52) U.S. Cl. ..... 400/134; 400/88; 409/64

(58) Field of Classification Search ..... 400/134, 400/323, 88, 138.2; 358/3.32, 1.3; 101/32, 101/3.1; 409/64
See application file for complete search history.

(56) References Cited

U.S. PATENT DOCUMENTS

| | | | | |
|---|---|---|---|---|
| 2,907,620 | A * | 10/1959 | Van Luik, Jr. | 346/8 |
| 3,577,828 | A * | 5/1971 | Stickney | 409/199 |
| 3,872,596 | A * | 3/1975 | Pardubsky | 33/27.11 |
| 3,937,873 | A * | 2/1976 | Gastineau | 358/3.29 |
| 4,031,369 | A * | 6/1977 | Heaman et al. | 700/189 |
| 4,089,262 | A | 5/1978 | Sopora | |
| 4,089,292 | A | 5/1978 | Laboy | |
| 4,213,427 | A | 7/1980 | Di Stefano | |
| 4,225,154 | A * | 9/1980 | Takada | 280/804 |
| 4,343,087 | A | 8/1982 | Simon | |
| 4,400,913 | A * | 8/1983 | Krantz et al. | 49/352 |
| 4,495,845 | A | 1/1985 | Sherby | |
| 4,577,409 | A * | 3/1986 | Sakamoto et al. | 33/18.1 |
| 4,834,595 | A | 5/1989 | Cacciotti | |
| 5,628,594 | A * | 5/1997 | Fetty | 409/144 |
| 5,751,436 | A * | 5/1998 | Kwon et al. | 219/121.68 |
| 6,128,024 | A * | 10/2000 | Carver | 345/441 |
| 6,430,820 | B1 * | 8/2002 | Chessari et al. | 33/26 |
| 6,450,710 | B1 * | 9/2002 | Foster et al. | 400/58 |
| 6,491,361 | B1 | 12/2002 | Spann | |
| 6,494,307 | B1 | 12/2002 | Kozak et al. | |
| 6,499,840 | B2 | 12/2002 | Day et al. | |
| 6,843,328 | B2 | 1/2005 | Boyl-Davis et al. | |
| 7,054,708 | B1 | 5/2006 | Aamodt et al. | |

(Continued)

FOREIGN PATENT DOCUMENTS

| | | | |
|---|---|---|---|
| JP | 61119518 A | * | 6/1986 |
| WO | WO 2004/056577 | | 7/2004 |
| WO | 2007/018941 | | 3/2008 |
| WO | 2007/018941 | | 3/2009 |

*Primary Examiner* — Daniel J Colilla
*Assistant Examiner* — David Banh
(74) *Attorney, Agent, or Firm* — Scott T. Griggs; Griggs Bergen LLP

(57) ABSTRACT

A handheld pattern creating device and method of use of the same are disclosed. In one embodiment, a rotational member is rotatably positioned within a housing under the power of a first drive mechanism to angularly traverse an x-y plane. A rail track is disposed on the surface of the rotational member in order to provide a radial path for a carriage that houses a tool tip. A guide track disposed on a surface of the rotational member includes a curved portion that provides a non-linear path. A second drive mechanism drives the carriage transversely along the radial path of the rail track such that a flexible rack gear travels the non-linear path of the guide track.

15 Claims, 8 Drawing Sheets

U.S. PATENT DOCUMENTS

2003/0007023 A1 1/2003 Barclay et al.
2003/0033151 A1* 2/2003 Vozick et al. ..... 704/275
2004/0134755 A1 7/2004 Sticht et al.
2005/0000337 A1 1/2005 Ahne et al.
2006/0007292 A1 1/2006 Ohmori et al.
2006/0169269 A1 8/2006 Baratta

* cited by examiner

HANDHELD PATTERN CREATING DEVICE AND METHOD OF USE OF SAME

PRIORITY STATEMENT & CROSS-REFERENCE TO RELATED APPLICATIONS

This application claims priority from co-pending U.S. patent application Ser. No. 60/840,387, entitled "Handheld Cutter and Plotter Devices", filed on Aug. 25, 2006, and pending through Aug. 27, 2007, in the names of Josh Malone and Michael Wuensch; which is hereby incorporated by reference for all purposes.

TECHNICAL FIELD OF THE INVENTION

This invention relates, in general, to scrapbooking, card making, and related crafts and, in particular, to a handheld pattern cutting device and associated method of use for cutting or drawing designs including shapes, graphics, letters, numbers, words and the like out of a media such as paper or cloth.

BACKGROUND OF THE INVENTION

Traditionally, highly specialized computer controlled pattern machines such as plotters, cutters, engravers, and routers have been used commercially. These machines have not been suitable for the consumer market due to the specialized training required for operation and high cost. Recent technology and manufacturing advancements, however, have enabled versions of these commercial machines to begin to enter the consumer market.

A major limitation of these newer consumer devices is a small pattern size to machine footprint ratio. Compared to the footprint of the machine, the handheld varieties create small patterns due to the area required for the traditional Cartesian x-y drive mechanisms which require bulky gear assemblies and mounting features that reside external to the cutting area. Accordingly, improvements are warranted in the field of handheld pattern creating devices.

SUMMARY OF THE INVENTION

A handheld pattern creating device and method of use of the same are disclosed which provide for an increased pattern size to machine footprint ratio. The present invention utilizes a polar coordinate-based drive mechanism and space-conscious gear assemblies and mounting features having a reduced form factor such that all components reside within the cutting area.

In one embodiment of the handheld pattern creating device, a rotational member is rotatably positioned within a housing under the power of a rotational drive mechanism to angularly traverse an x-y plane in a polar coordinate-based fashion. A rail track is disposed on a surface of the rotational member in order to provide a radial path for a carriage that houses a tool tip, such as a cutting blade or plotter pen. A guide track disposed on the surface of the rotational member includes a curved portion that provides a non-linear path. A radial drive mechanism drives the carriage transversely along the radial path of the rail track such that a flexible rack gear travels the non-linear path of the guide track. In another implementation, a radial member is utilized with the rotational member. In particular, the radial member is mounted to the rotational member under the power of a radial drive mechanism to traverse a path that substantially intersects the center of rotation of the rotational member. A carriage which is mounted to the radial member provides actuation in the z-axis. A particular embodiment provides a means for the radial member to travel a distance that is greater than the distance of a substantially circular body of the rotational member.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
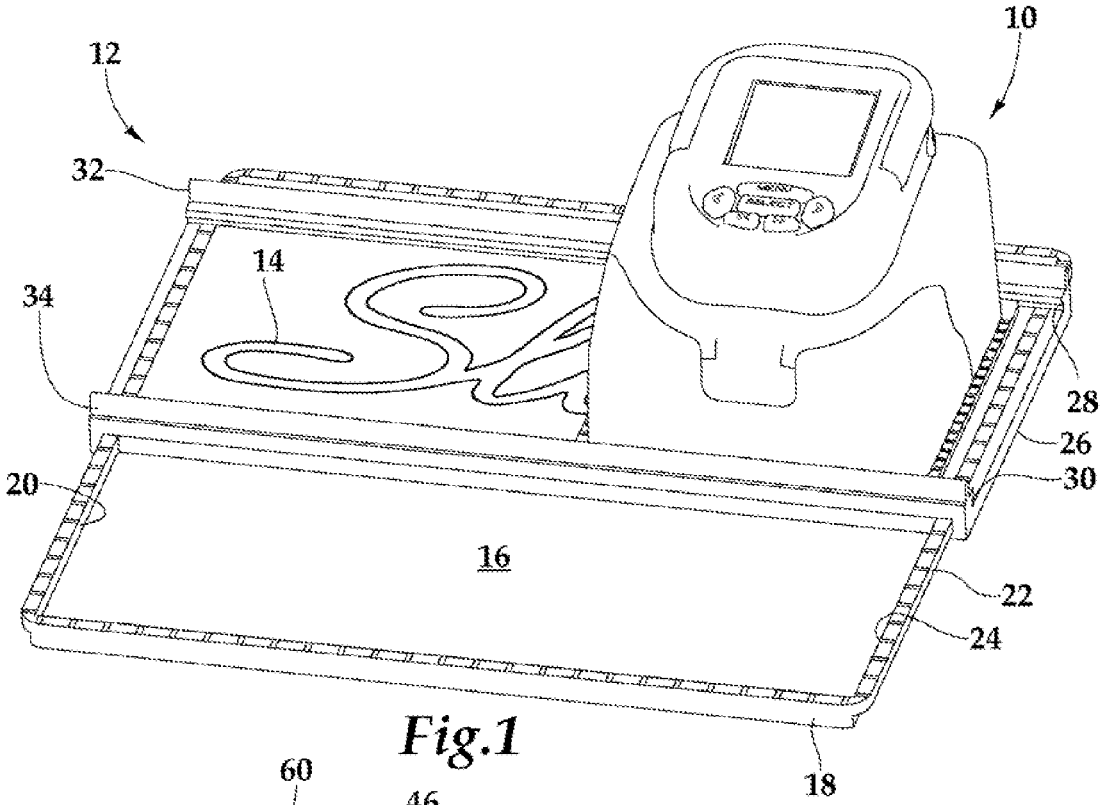
FIG. 1 is a perspective view of a system for creating a pattern on media wherein one embodiment of a pattern creating device is being utilized.
Figure 2:
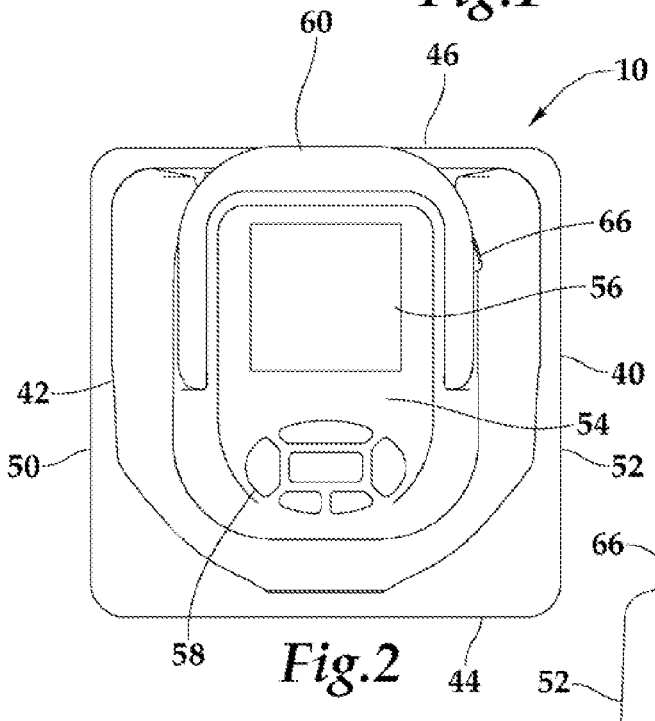
FIG. 2 is a top plan view of the pattern creating device illustrated in FIG. 1.
Figure 3:
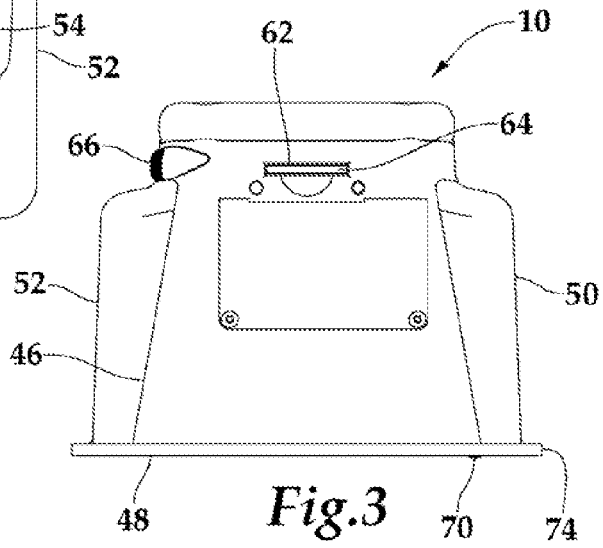
FIG. 3 is a rear plan view of the pattern creating device illustrated in FIG. 1.

Referring initially to FIG. 1, therein is depicted a pattern creating device 10 being utilized in a system 12 for creating a pattern 14 in media 16. A cutting mat 18 includes a work holder 20 for accepting and securing the media 16, which may include fabric, textile, paper, and the like, for example. A shoulder 22 is integrally formed from an edge 24 of the cutting mat 18 to provide releasable engagement for a platform 26, which when engaged, as illustrated, traversely superposes the cutting mat 18 and the media 16. Parallel rails 28, 30 are disposed on the platform 26 and adapted to accept the pattern creating device 10 and permit the pattern creating device 10 to linearly traverse the media 16 under the power of a user employing bars 32, 34 of the platform 26, which provide hands free alignment and movement of the pattern creating device 10.

The pattern creating device 10 presented herein utilizes, as will be discussed in further detail hereinbelow, rotational mechanisms and a polar coordinate-based system to provide a handheld tool that controls a tool tip, such as a cutting blade or plotter pen, for example, and performs a wide array of cutting, design, and pattern operations on any suitable media. These operations may further include cutting, drawing, plotting, milling, routing, or engraving, for example. The handheld pattern cutting device 10 and associated method of use provide for cutting or drawing designs including shapes, graphics, letters, numbers, words and the like out of a media such as paper or cloth.

It should be appreciated that although a cutting mat and platform are shown in FIG. 1, the media 16 may be held in place by any suitable technique. By way of example, a user may utilize the pressure of one hand or fingers to stabilize the media while holding the device against the media with the other hand. By way of another example, a sticky mat or spray adhesive may be used. Further still, magnets and magnetic material may be distributed between the cutting mat and pattern creating device to provide a magnetic force between the cutting mat and pattern creating wherein the media is securably interposed therebetween. Other techniques include pin and work holder arrangements as well hinge arrangements.

FIGS. 2 through 6 depict additional views of the pattern creating device. A housing 40 includes a top side 42, a front side 44, a rear side 46, a bottom side 48, and two lateral sides 50, 52. The top side 42 accommodates a graphical user interface 54 which includes a monitor 56 and input controls 58. A moveable handle 60, which is illustrated in a storage position, is rotatably coupled to the top side 42. An input port 62 disposed near the junction of the top side 42 and the rear side 46 accepts a memory card 64, such as a solid state electronic memory device. A cut button 66 by which the user actuates the cutting process is positioned adjacent to the input port 62. The housing 40 is adapted to include a window 68 through which the alignment of the pattern creating device 10 and, in particular, a tool tip 70, may be compared to the media 16. The window 68 may comprise any transparent material, such as a clear plastic.

Figure 4:
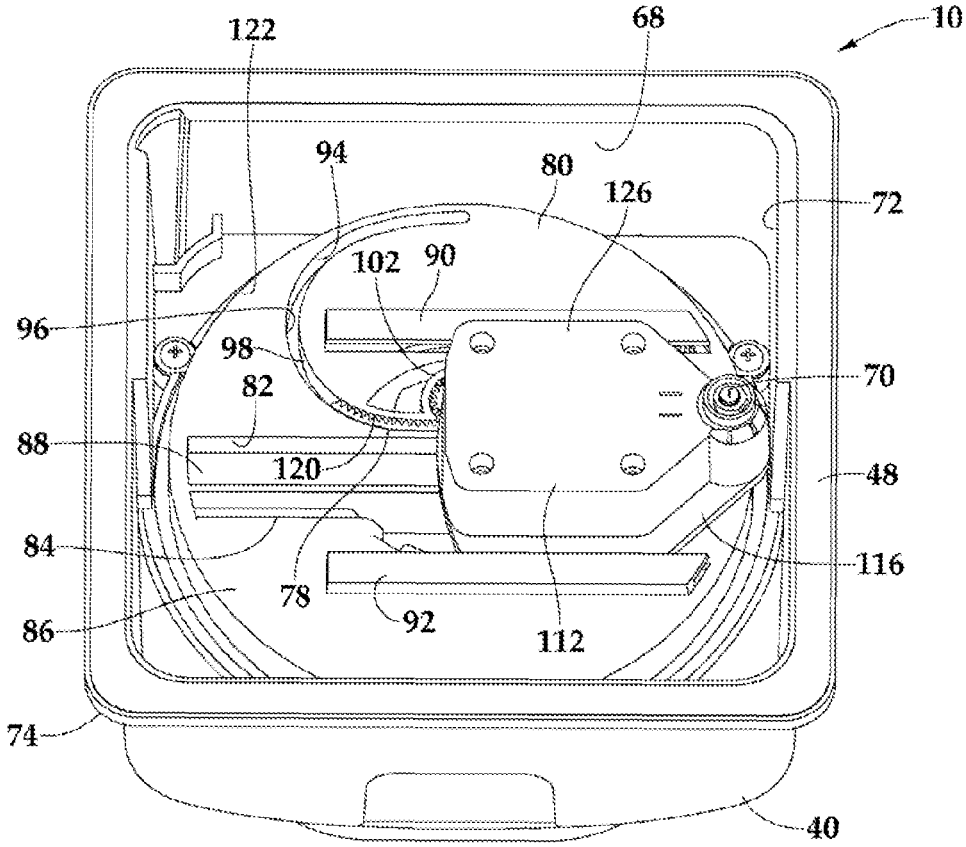
FIG. 4 is bottom perspective view of the pattern creating device illustrated in FIG. 1.
Figure 5:
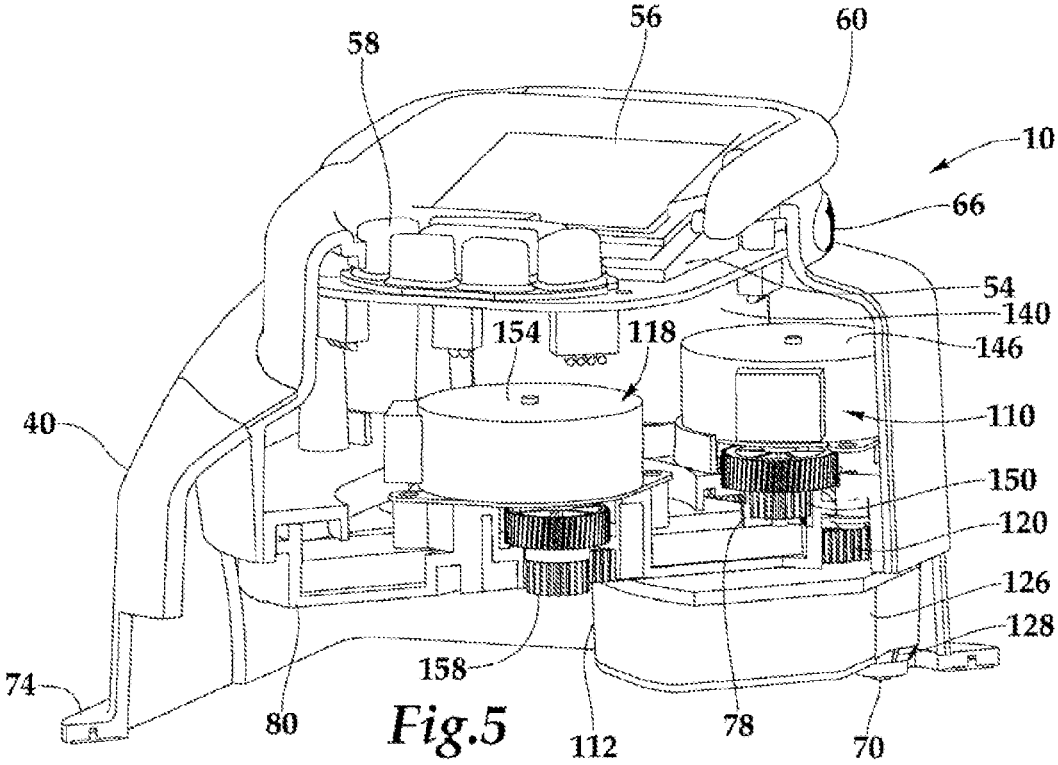
FIG. 5 is a cross-sectional perspective view of one embodiment of internal components of the pattern creating device illustrated in FIG. 1.
Figure 6:
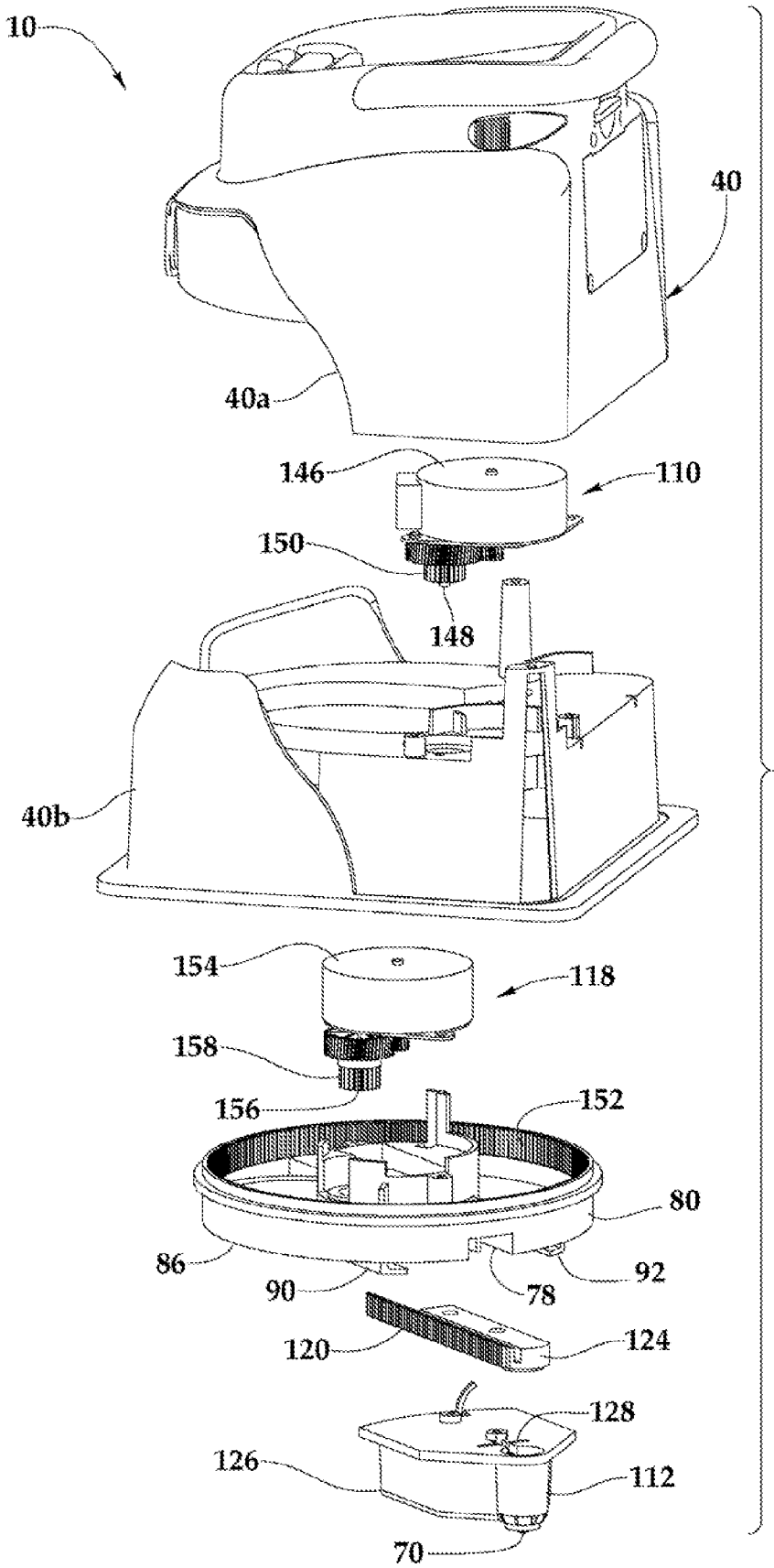
FIG. 6 is an exploded view of particular internal components illustrated in FIG. 5.

The housing 40 includes an opening 72 at the bottom side 48 thereof and may comprise two sections, an upper housing 40*a* and a lower housing 40*b*. The two housings 40*a*, 40*b* having complimentary forms that mate. A flanged portion 74 extends from the housing 40 proximate to the opening 72 to provide an increased contact area between the housing 40 and the media 16, and to provide a surface for printed or embossed ruler markings. The tool tip 70, which in the embodiments that comprise a cutting blade may include a removable protective sheath (not depicted) disposed thereon, may retractably extend from the housing 40 in order to contact the media 16 during pattern creation which may involve the cutting or drawing, for example, of shapes, graphics, letter, numbers, words, or the like. As best seen in FIG. 4, a radial member 78 is mounted to the rotational member 80, which is positioned within the housing 40. In one implementation, the radial member 78 includes a rail track 82 at least partially formed from a support structure 84 is disposed on a surface 86 of the rotational member 80 to provide a linear, radial pathway 88 between two spaced parallel runners 90, 92, which form a portion of the rail track 82. As depicted in the illustrated embodiment, the rail track 82 substantially bisects the rotational member 80.

In one implementation, a guide track 94 integrally formed from the rotational member 80 includes an arcuate or curved portion 96 that provides a non-linear path 98 as well as a linear portion 100. The radial member 78 which includes an inset 102, for accommodating sub-components of the radial member 78, is disposed within the rotational member 80 and adjacent to the guide track 94 at a location between the rail track 82 and the parallel runner 90. A rotational drive mechanism 110, which may be referred to as a first drive mechanism, is disposed within the housing 40. Under the power of the rotational drive mechanism 110, the rotational member 80 angularly traverses an x-y plane relative to the housing 40.

A carriage 112 is slidably mounted to the rail track 82 by flanges 114, 116 which extend therefrom to slidably engage the parallel runners 90, 92. Under the power of a radial drive mechanism 118, which may be referred to as a second drive mechanism and forms a portion of the radial member 78, the carriage 112 linearly and radially traverses the pathway 88 of the rail track 82. The radial drive mechanism 118 is secured within the housing 40 and partially disposed within the inset 102. A flexible rack gear 120, which forms a portion of the radial drive mechanism 118 and therefore the radial member 78, is adapted to travel the curved portion 96 of the guide track, which as mentioned, also includes a linear portion 100 to permit the maximum extension of the flexible rack gear 120. As illustrated, in one implementation, the rotational member 80 includes a substantially circular body 122 having a radius r. In this implementation, the flexible rack gear 120 includes a length greater than the radius r which is accepted by the guide track 94.

With respect to the radial movement and length of the flexible rack gear 120, the radial member 78, being slidably mounted to the rotational member 80, under the power of a radial drive mechanism 118, traverses a pathway 88 substantially through the center of rotation of the rotational member 80. In particular, the flexible rack gear 120 of the radial member 78 is adapted to traverse the curved guide track 94. In another implementation, the radial drive mechanism 118 includes a plurality of synchronized pinion gears disposed parallel to the pathway 88 and the radial member further comprises a rack gear adapted to engage less than the full number of pinion gears when positioned at an extremity of the traversal pathway, such as the locations when the carriage 112 is completely retracted or completely extended.

Additionally, a lateral member 124 is attached at one end of the flexible rack gear 120 in such a way as to move concurrently with the flexible rack gear 120 and retain a slidable attachment between the flexible rack gear 120 and the rotational member 80. The carriage 112 includes a casing 126 which houses an internal z-axis drive mechanism 128 that controls the movement of the tool tip 70 through a z-axis relative to the housing 40.

A computer controller interfaces 140 with the user via the graphical user interface 54, the monitor 56, and the input controls 58, and directs the tool tip 70 and pattern creating by sending control signals to the drive mechanisms; namely, the rotational drive mechanism 110, the radial drive mechanism 118, and the z-axis drive mechanism 128 of carriage 112. The computer controller 140 includes various electronic components and has access to a memory volume having a pattern library disposed thereon. The pattern library is utilized to translate the user's pattern selection into a created pattern on the media. As will be discussed in greater detail hereinbelow, users have several ways of obtaining and designing patterns for use with the pattern creating device 10. It should be appreciated that the computer controller 140 may include any combination of hardware, software, and firmware for processing and executing the required instructions and control signals.

In one embodiment, the housing 40 as well as portions of the other components may comprise thermoplastic and/or thermosetting plastic materials formed by injection molding. The rotational drive mechanism 110 is superposed on the rotational member 80 and both are secured within the housing 40. The radial drive mechanism 118 is at least partially disposed on the rotational member 80 which includes various tabs and male and female connectors to rotatably secure the rotational member 80 to the housing 40.

With respect to the rotational drive mechanism 110, an electric motor 146 is secured within the housing 40 for transferring torque to an output shaft 148 to which a gear 150, which may be a pinion gear, is attached. A set of gear teeth or ring gear 152 extending from the rotational member 80 are disposed in a meshed relationship with the gear 150. With respect to the radial drive mechanism 118, similar to the rotational drive mechanism 110, an electric motor 154 is disposed on the rotational member 80 to transfer torque to an output shaft 156 having a pinion gear 158 attached thereto. The flexible rack gear 120 is disposed in a meshed relationship with the pinion gear 158.

The flexible rack gear 120 is positioned on the surface 86 of the rotational member 80 as is the support structure 84 which forms a portion of the rail track 82. The carriage 112, which as with the other components includes tabs and other securing means, is slidably secured to the support structure 84 and the surface 86 of the rotational member 80.

It should be appreciated that the components described herein may be manufactured from various natural and synthetic materials including plastics, metals, composites, and the like. Further, the electric motors used in the rotational and radial drive mechanisms 110, 118 may be DC motors, hybrid steppers, DC servo motors, or linear motors, for example, that are driven by Darlington transistor arrays, FET arrays, power switching transistor and relay arrangements, or any combination thereof. As illustrated, the pattern creating device 10 is powered by a battery. It should be appreciated, however, that alternative sources of power are within the teachings presented herein. For example, corded power attachments with AC/DC adaptors, USB interfaces, and disposable batteries are available options.

Figure 7:
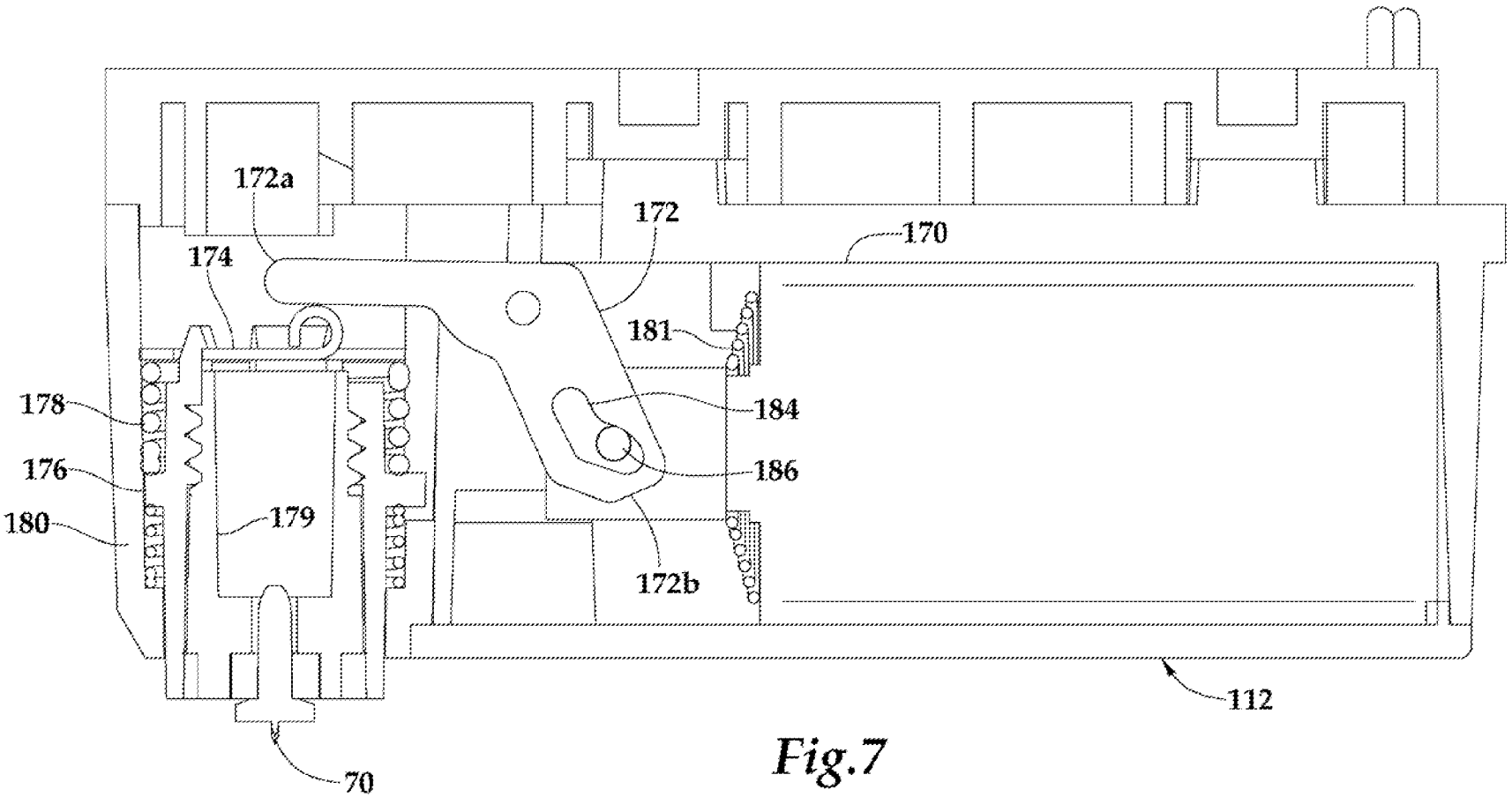
FIG. 7 is a side plan view of one embodiment of a carriage and a tool tip.

FIG. 7 depicts one embodiment of the carriage 112 and the tool tip 70. The z-axis drive mechanism 128 that includes a z-axis actuator 170 including a solenoid 181 is disposed within the casing 126 of the carriage 112 for controlling the pivot of a lever 172 against a retainer clip 174. The retainer clip 174 is coupled to a piston 176 via a compression spring 178 that applies a designed pre-load to the piston. The piston houses a ball bearing assembly 179, which in turn holds the tool tip 70. A lift spring 180 applies a light load to the piston 176 to keep it in the raised position until the solenoid 181 is energized, which pulls in a lower end of the lever 172*b* and causes an upper end of the lever 172*a* to pivot downward against the retainer clip 174.

The retainer clip 174, the compression spring 178, the piston 176, a tool bearing assembly 183, and the tool tip 70 move downward in unison until the tool tip 70, which may be a cutting blade, pierces the media 16 and bottoms out on a cutting surface, such as mat, at which point only the retainer clip 174 continues moving downward until the solenoid 181 has completed transition to the energized position. In this way a load slightly greater than the designed pre-load of the compressed spring is applied during the cutting process. In this manner, the z-axis position of the tool tip 70 and the force and pressure applied to the media 16 may be controlled.

Figure 8:
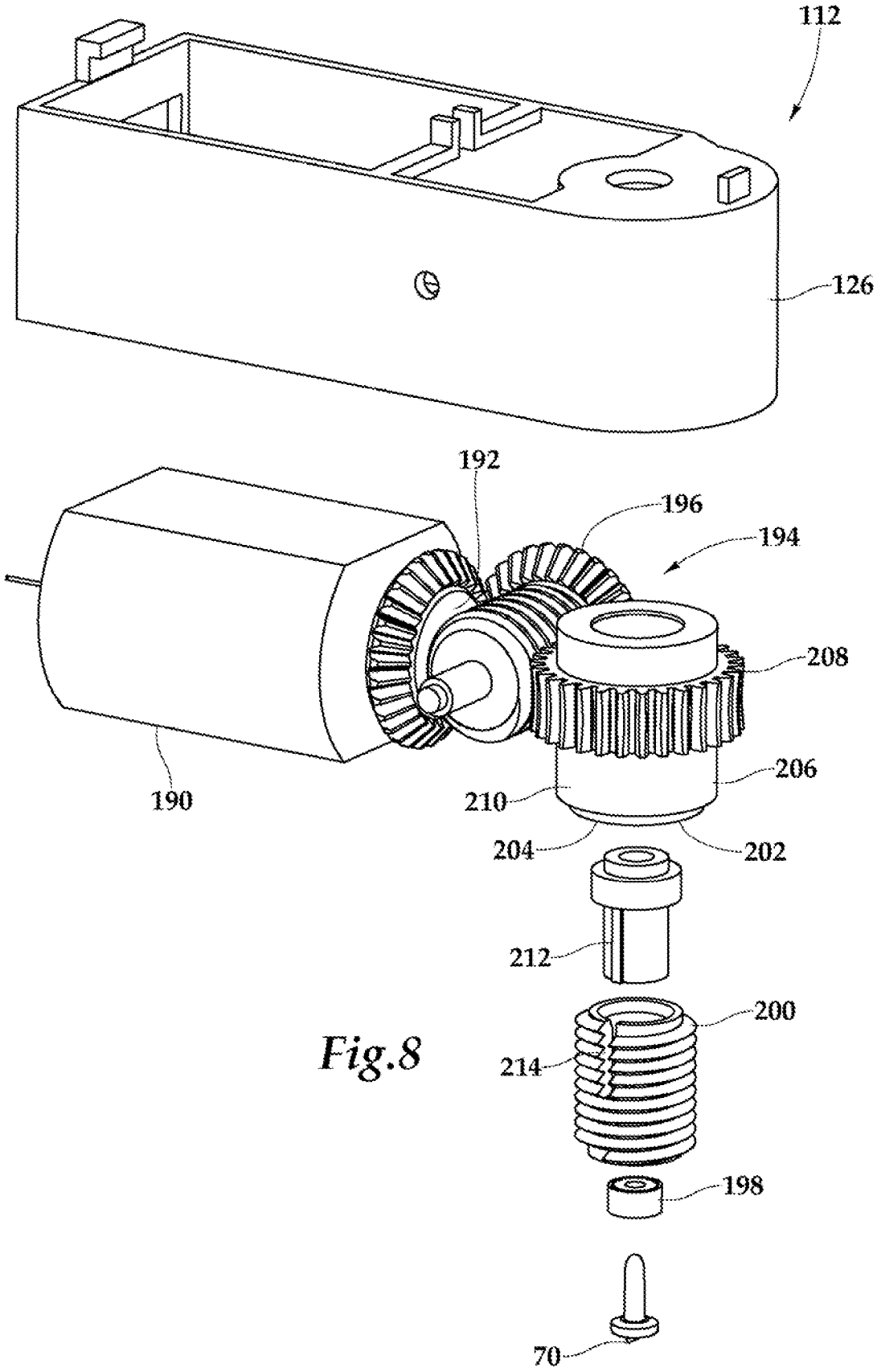
FIG. 8 is an exploded view of another embodiment of the carriage and the tool tip.

FIG. 8 depicts another embodiment of the carriage 112 and the tool tip 70. An electric motor 190 is secured within the casing 126 of the carriage 112 to transmit torque to an output shaft 192. A gear train 194 couples the output shaft 192 to the tool tip 70 such that the tool tip 70 is operable to controllably traverse the z-axis relative to the housing 40. As depicted, the gear train 194 includes a worm gear 196 attached to the output shaft 192. A tool tip holder 198 having male helical threads 200 formed thereon is engaged by female helical threads 202 formed on an interior surface 204 of a tool tip guide 206. Gear teeth 208 extending from an exterior surface 210 of the tool tip guide 206 mate with the worm gear 196. As depicted, the carriage 112 includes a keyed shaft 212 that at least partially extends into a complementary slot 214 of the tool tip holder 198 which rotationally constrains the tool tip holder 198. As the electric motor 190 is driven in the forward direction, the rotation of the tool tip guide 206 unscrews the tool tip holder 198, causing it to move downward to engage the media 16. The travel depth of the tool tip holder 198 is determined by the on time of the electric motor 190, or by an encoder monitored by the computer controller 140, or by a measuring pressure via correlation to motor current, monitored by the computer controller 140. In one implementation, the z-axis drive mechanism 128 includes electronics that monitor torque and/or power consumption of the z-axis actuator 170, which may include a motor, to thereby monitor the force and pressure, through a correlation, of the tool tip 70 on the media 16.

FIGS. 9 through 12 depict the pattern creating device 10 in operational embodiments wherein a portion of the casing 126 of the carriage 112 has been removed to expose the flexible rack gear 120. As previously discussed, the drive mechanism of the pattern creating device 10 is polar coordinate-based. The rotational drive mechanism 110 controls the angular coordinate of the tool tip 70 as depicted by double-headed arrow 220. In particular, the rotational drive mechanism 110 rotates the rotational member 80 which, in turn, angularly displaces the rail track 82 as well as the carriage 112, which holds the tool tip 70. On the other hand, the radial drive mechanism 118 controls the radial coordinate of the tool tip 70 as depicted by double-headed arrow 222. More specifically, the radial drive mechanism 118 controls the position of the carriage 112 and the tool tip 70 in the rail track 82 which substantially bisects the radius of the rotational member 80.

Figure 9:
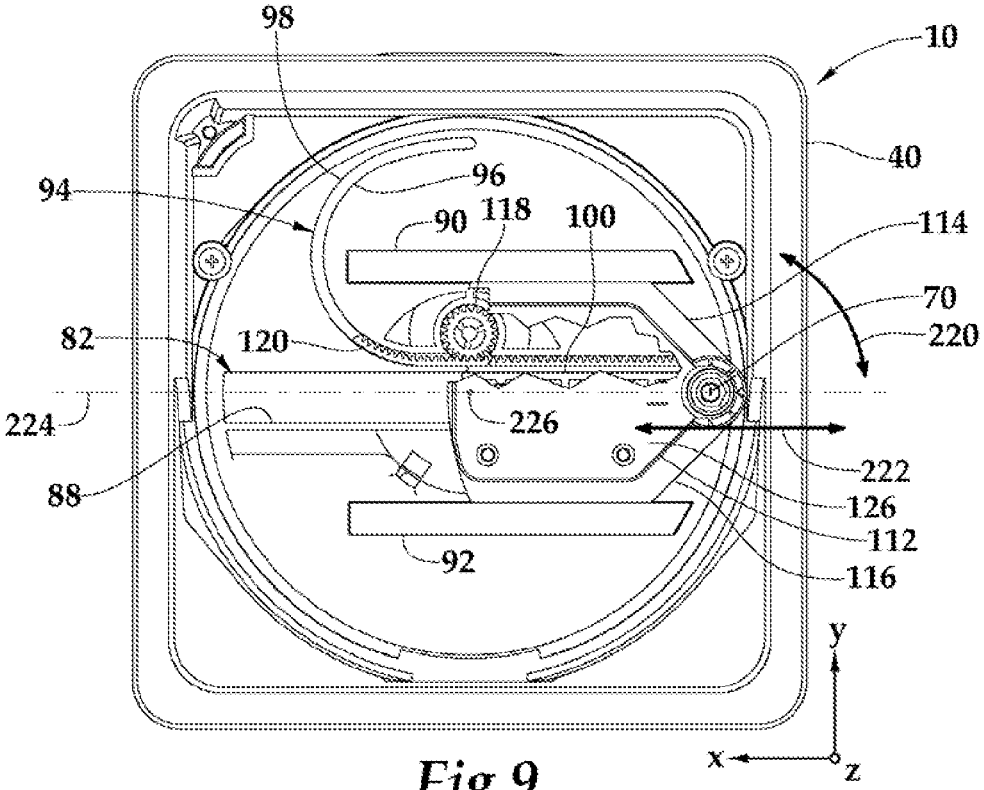
FIG. 9 is a bottom plan view, with particular components removed, of the pattern creating device illustrated in FIG. 1 in operation and creating a pattern.

With reference to FIG. 9, the tool tip 70 is positioned by the side along a line which may be considered a polar axis, which is designated by number 224, originating from a pole, which is designated by number 226. In this position, the rotational drive mechanism 110 has not angularly displaced the tool tip 70 from the polar axis 224 while the radial drive mechanism 118 has radially displaced the tool tip 70 along the polar axis 224 from the pole 226 of the rotational member 80 to the edge of the rotational member 80. Here, the flexible rack gear 120 is substantially extended with a length running from the pinion gear 158 along the linear portion 100 of the guide track 94 through to the carriage 112.

Figure 10:
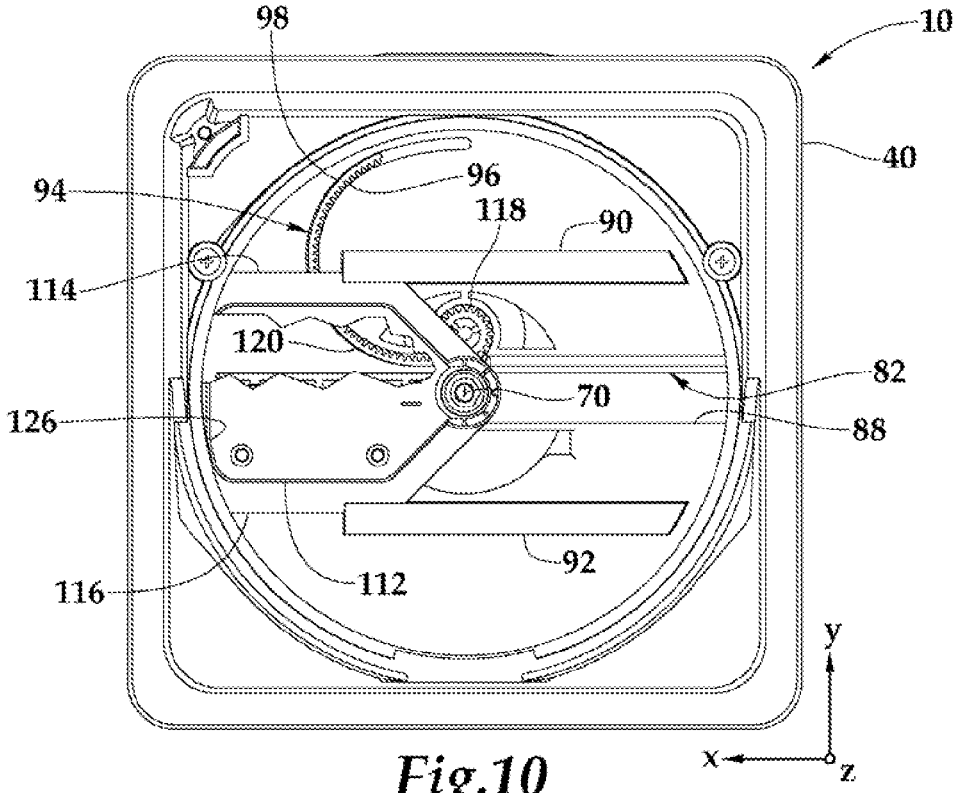
FIG. 10 is a bottom plan view, with particular components removed, of the pattern creating device illustrated in FIG. 1 in operation and creating a pattern.

With reference to FIG. 10, the tool tip 70 is positioned substantially at the pole 226. To transition the tool tip 70 from the position at the side as shown in FIG. 9 to the position at the pole 226, the radial drive mechanism 118 retracts the carriage 112 and the tool tip 70. As the retraction occurs, the flexible rack gear 120 travels through the non-linear path 98 of the curved portion 96 of the guide track 94. The non-linear path 98 of the curved portion 96 minimizes the radial footprint of the flexible rack gear 120 and permits the non-linear path 98 to accept a flexible rack gear 120 having a length greater than r, which is the radius of the rotational member 80. It should be appreciated that although the rotational member 80 is presented as having a substantially circular body 122, other shapes and forms for the rotational member 80 are within the teachings presented herein. Further, as one skilled in the art will appreciate, the other shapes and forms may have dimensions other than a radius, an axis other than a polar axis, and a center other than a pole.

Figure 11:
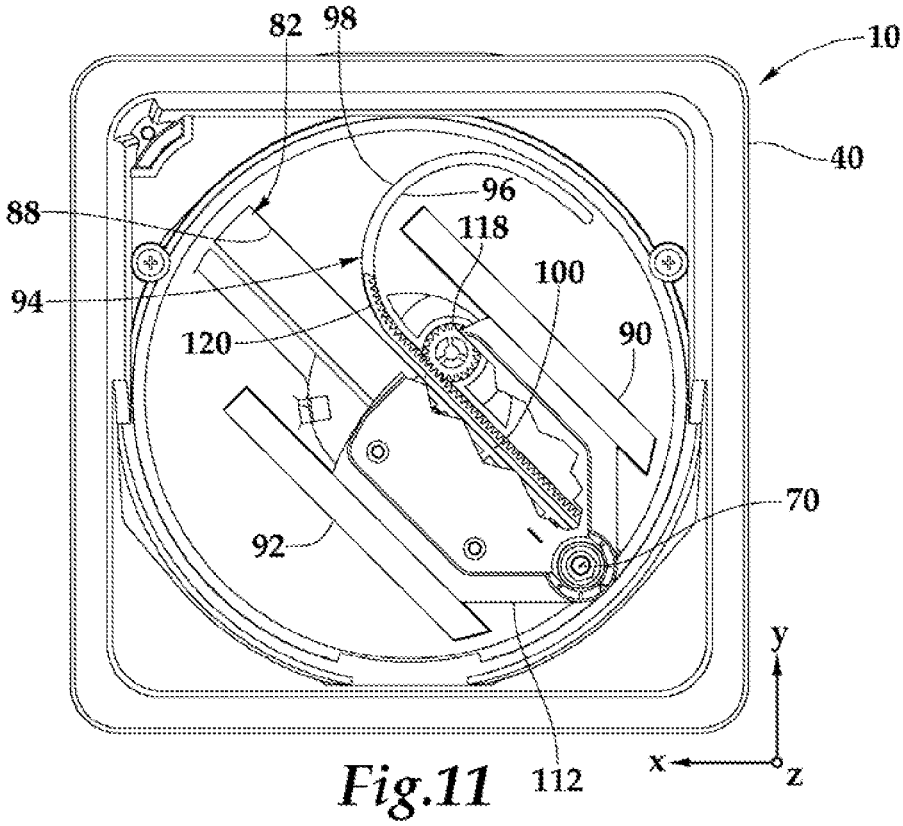
FIG. 11 is a bottom plan view, with particular components removed, of the pattern creating device illustrated in FIG. 1 in operation and creating a pattern.

With reference to FIG. 11, the tool tip 70 is positioned at a 270° angle from the polar axis 224 at the edge of the rotational member 80. To move the tool tip 70 from the position illustrated in FIG. 10 to that shown in FIG. 11, the rotational drive mechanism 110 rotates the tool tip 70 and the radial drive mechanism 118 linearly advances the tool tip 70 to the position as shown. These operations may occur in any order or substantially simultaneously.

Figure 12:
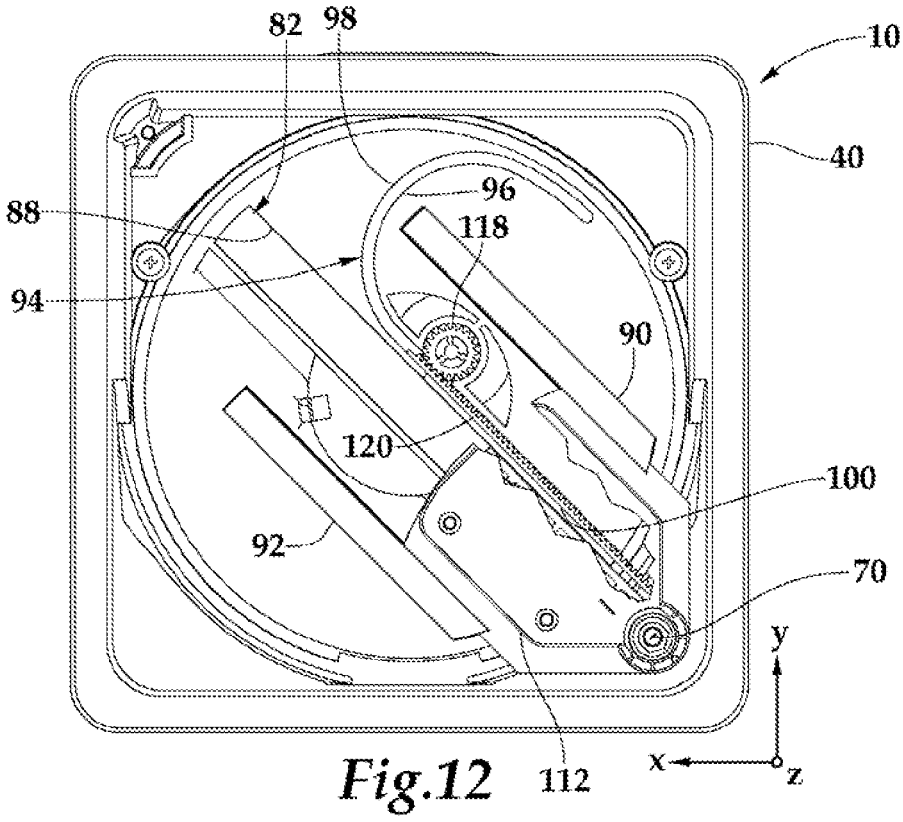
FIG. 12 is a bottom plan view, with particular components removed, of the pattern creating device illustrated in FIG. 1 in operation and creating a pattern.

With reference to FIG. 12, the tool tip 70 is positioned at the identical polar angle or azimuth angle as the tool tip 70 of FIG. 11. In FIG. 12, however, the tool tip 70 is disposed in a hyper-extended position, wherein the tool tip 70 is extended beyond the rotational member 80 to a location between the rotational member 80 and the housing 40. The flexible rack gear 120 is substantially completely linearly extended along the linear portion 100 of the guide track 94 parallel to the rail track 82. The linear portion 100 of the flexible rack gear 120 permits extension beyond the rotational member 80 to the housing 40 and the curved portion 96 of the guide track 94 provides the path within the confines of the rotational member 80 to accept the flexible rack gear 120, which in the illustrated embodiment has a length greater than the radius of the rotational member 80. Therefore, the pattern creating device 10 includes a tool tip having a radial travel distance greater than the diameter of the rotational member 80. With reference to FIGS. 9 and 12, two opposite radial positions of the tool tip 70 and the flexible rack gear 120 may be compared. In FIG. 9, the tool tip 70 is positioned at the pole 226 of the rotational member 80 and the flexible rack gear 120, which has a length greater than the radius of the rotational member 80, is coiled or curved through the curved portion 96 of the guide track 94. On the other hand, in FIG. 12, the tool tip 70 and the flexible rack gear 120 are completely extended and the linear portion 100 of the guide track 94, as opposed to the curved portion 96, is utilized.

Accordingly, it should be appreciated that the tool tip 70 may be positioned at any location within the housing 40 through the polar coordinate-based cooperation of the rotational and radial drive mechanisms 110, 118. The pattern creating device 10 thus creates patterns by maneuvering the angular and radial displacement of the tool tip 70 as discussed above and controlling the contact of the tool tip 70 with the media 16. As discussed, the z-axis drive mechanism 128 controls the z-axis position, and the force and pressure of the contact, with the media 16 to create the desired pattern by implementing selective cutting operations in accordance with the desired pattern 14. With this arrangement, the rotational drive mechanism 80 and radial drive mechanism 78 are substantially contained within a projection of a cutting area defined by movement of the carriage.

A large number of applications benefit from a larger pattern size to machine footprint ratio as provided by the handheld pattern creating device 10 presented herein. In particular, the structures and functions of the rotational and radial drive mechanisms 110, 118 are contained within the housing 40 to minimize the form factor and footprint and maximizes the pattern creating area. The pattern creating device presented herein provides drive mechanisms which are contained within the footprint of the cutting area. Using one embodiment of the design presented hereinabove, the pattern creating device 10 does not exceed a 5 inch (12.7 centimeters) by 5 inch (12.7 centimeters) square area. These dimensions are substantially within a range which qualifies as "handheld". Additionally, the pattern creating device 10 may produce a pattern as large as or larger than 4 inches (10.2 centimeters) by 4 inches (10.2 centimeters). A size which is necessary for many potential applications. In addition to enabling a smaller machine with useful pattern sizes, the pattern creating device 10 presented herein reduces cost with efficient use of inexpensive parts and saves work and desk space.

Figure 13:
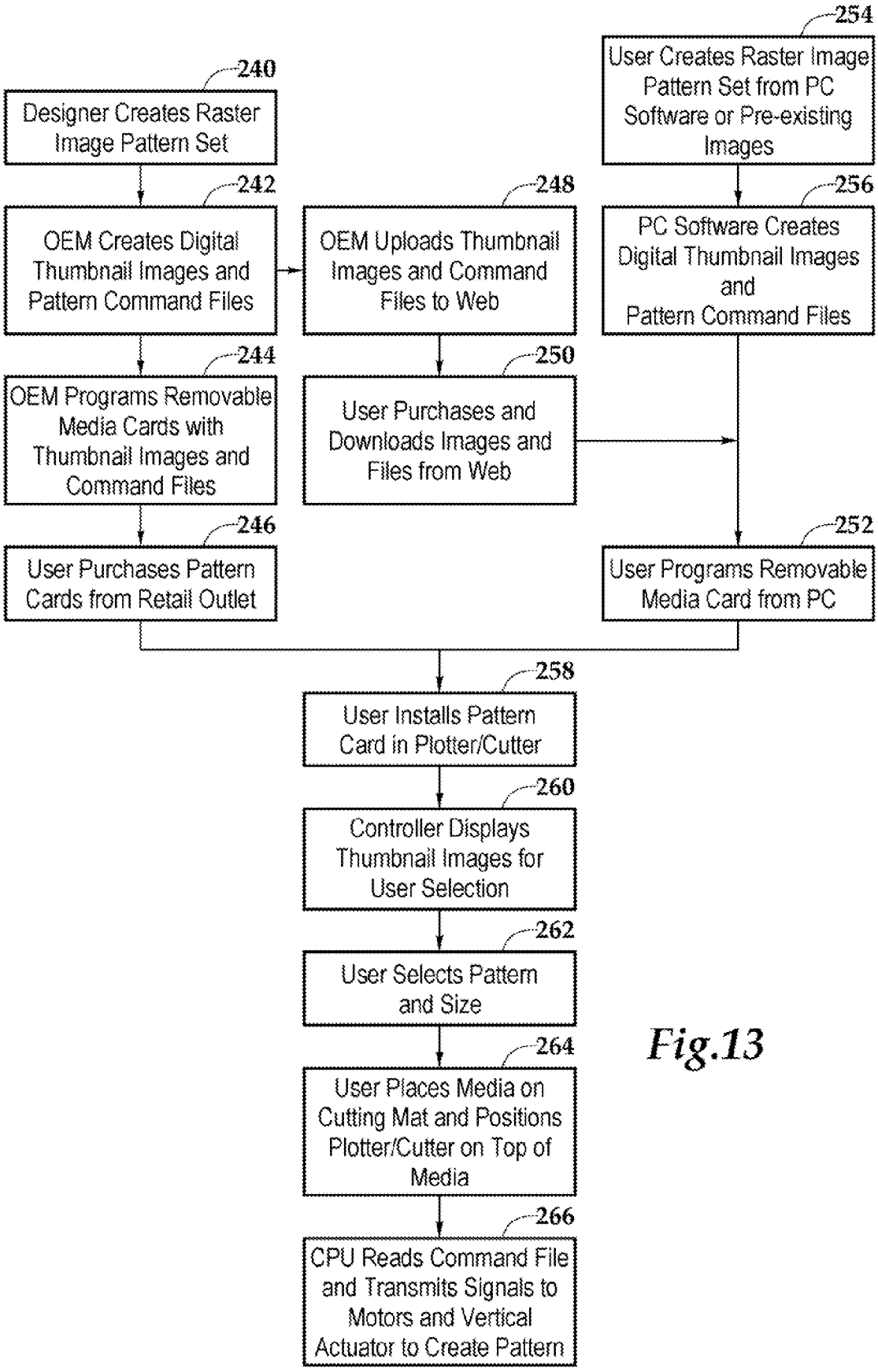
FIG. 13 is flow chart of one embodiment of a method for using the pattern creating device illustrated in FIG. 1.

FIG. 13 depicts one embodiment of a method for using the pattern creating device. At block 240, a designer creates a raster image pattern set which may include a data file or a data structure representing an outline or form of a shape, pattern or the like, viewable via a computer monitor, paper, or other display medium. At block 242, the original equipment manufacturer (OEM) creates digital thumbnail images and pattern command files which may be programmed onto removable memory cards or media cards, which may also be referred to as pattern cards, at block 244. At block 246, users may purchase these pattern cards from retail outlets.

Returning to block 242, as an alternative, the methodology may advance to block 248, where the OEM uploads the thumbnail images and command files to a website on the Internet to permit users to purchase and download the files at block 250. Once the user purchases and downloads the files to a personal computer, for example, the files may be placed onto a media card as shown at block 252.

At block 254, a user creates a raster image pattern set from software or pre-existing images and then, at block 256, digital thumbnail images and pattern command files are created. This method of creating pattern command files advances to the previously discussed block 252, where the user programs a removable media card. The options presented in blocks 240 through 252 permit a user with several techniques to create patterns. It should be appreciated, however, that the present technology is not limited to only these options.

Regardless of the technique used to create the pattern, at block 258, the user may then install the pattern card and the associated data onto the pattern creating device. A plurality of images of patterns are displayed on a graphical user interface of the handheld pattern creating device at block 260. A user then selects a pattern at block 262 from the plurality of images of patterns. At block 264, the media is mounted to a cutting mat prior to the handheld pattern creating device being positioned on the cutting mat also at block 264. At this time, the positioning of the tool tip, or cutting blade in particular embodiments, proximate to the media may be viewed, verified, and adjusted through a window of the handheld pattern creating device.

At block 266, the handheld pattern creating device is instructed to create the selected pattern and in particular, a CPU or electronic component associated with computer controller reads the necessary command file and transmits signals to each of the drive mechanisms and vertical actuator mechanism to crate the patter. While creating the pattern, the handheld pattern creating device selectively radially traverses the media with the cutting blade. Additionally, while creating the pattern, the cutting blade selectively angularly traverses the media. The operations of selectively radially traversing the media and selectively angularly traversing the media repeatedly occur without regard to order. During these operations, the z-axis drive mechanism actuates the cutting blade up and down into contact with the media to create the pattern.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A handheld pattern creating device, comprising:

a housing having an opening at a bottom side thereof, the housing being sized for handheld operation of the handheld pattern creating device;

a rotational member, including a substantially circular body having a radius r, rotatably positioned within the housing, the rotational member, under the power of a first drive mechanism, being adapted to angularly traverse an x-y plane relative to the housing;

a rail track disposed on a surface of the rotational member, the rail track being adapted to provide a radial path;

a guide track disposed on the surface of the rotational member, the guide track including a curved portion that provides a non-linear path;

a carriage slidably mounted to the rail track, the carriage including a tool tip extending therefrom that is adapted to traverse a z-axis relative to the housing; and a second drive mechanism for driving the carriage transversely along the radial path of the rail track, the second drive mechanism including a flexible rack gear adapted to travel along the guide track, the flexible rack gear having a continuous length along the guide track which is greater than the radius r, such that the rack gear can flexibly travel through the curved portion of the guide track and provide the tool tip with a travel distance greater than the twice the radius of the circular body.

2. The handheld pattern creating device as recited in claim 1, further comprising a computer controller electrically coupled to the first drive mechanism, second drive mechanism, and carriage, the computer controller for interfacing with a user and directing the tool tip.

3. The handheld pattern creating device as recited in claim 2, wherein the computer controller further comprises access to a memory volume having a pattern library disposed thereon.

4. The handheld pattern creating device as recited in claim 1, wherein the first drive mechanism further comprises:

an electric motor disposed within the housing, the electric motor for transferring torque to an output shaft;

a pinion gear attached to the output shaft; and a ring gear disposed in the rotational member so as to mesh with the pinion gear.

5. The handheld pattern creating device as recited in claim 1, wherein the second drive mechanism further comprises:

an electric motor disposed on the rotation member, the electric motor for transferring torque to an output shaft;

a pinion gear attached to the output shaft; and a rack gear disposed on radial member so as to mesh with the pinion gear.

6. The handheld pattern creating device as recited in claim 1, wherein the carriage further comprises:

an actuator disposed within the carriage, the actuator for controlling the pivot of a lever;

a compression spring biased by the lever, the compression spring coupled to the tool tip such that the tool tip is operable to traverse the z-axis relative to the housing.

7. The handheld pattern creating device as recited in claim 1, wherein the carriage further comprises:

an electric motor disposed within the carriage, the electric motor for transmitting torque to an output shaft; and a gear train coupling the output shaft to the tool tip such that the tool tip is operable to traverse the z-axis relative to the housing.

8. The handheld pattern creating device as recited in claim 1, wherein the tool tip performs an operation selected from the group consisting of cutting, drawing, plotting, milling, routing, and engraving.

9. The handheld pattern creating device as recited in claim 1, wherein the tool tip creates a symbol selected from the group consisting of shapes, graphics, letters, numbers, and words.

10. The handheld pattern creating device as recited in claim 1, wherein the housing further comprises a window for preview and alignment of the tool tip with the media.

11. The handheld pattern creating device as recited in claim 1, wherein first drive mechanism and second drive mechanisms are contained within the housing and substantially within a projection of a cutting area defined by movement of the carriage.

12. A handheld pattern creating device, comprising:

a housing having an opening at a bottom side thereof;

a rotational member, including a substantially circular body having a radius r, rotatably positioned within the housing, the rotational member, under the power of a first drive mechanism, being adapted to angularly traverse an x-y plane relative to the housing;

a rail track disposed on a surface of the rotational member, the rail track being adapted to provide a radial path;

a guide track disposed on the surface of the rotational member, the guide track including a curved portion that provides a non-linear path;

a carriage slidably mounted to the rail track, the carriage including a tool tip extending therefrom that is adapted to traverse a z-axis relative to the housing;

a second drive mechanism for driving the carriage transversely along the radial path of the rail track, the second drive mechanism including a flexible rack gear adapted to travel along the guide track, the flexible rack gear having a continuous length along the guide track which is greater than the radius r, such that the rack gear can flexibly travel through the curved portion of the guide track and provide the tool tip with a travel distance greater than the twice the radius of the circular body; and a computer controller electrically coupled to the first drive mechanism, second drive mechanism, and carriage, the computer controller for interfacing with a user via a graphical-user-interface and directing the tool tip.

13. A system for creating a pattern, the system comprising:

a cutting mat including a work holder for accepting media;

a platform having parallel rails that traversely superpose the work holder, the platform for releasably engaging the cutting mat; a housing having an opening at a bottom side thereof; a flanged portion extending from the housing proximate to the opening, the flanged portion for releasably and slidably engaging the parallel rails of the platform;

a rotational member, including a substantially circular body having a radius r, rotatably positioned within the housing, the rotational member, under the power of a first drive mechanism, being adapted to angularly traverse an x-y plane relative to the housing;

a rail track disposed on a surface of the rotational member, the rail track being adapted to provide a radial path;

a guide track disposed on the surface of the rotational member, the guide track including a curved portion that provides a non-linear path;

a carriage slidably mounted to the rail track, the carriage including a tool tip extending therefrom that is adapted to traverse a z-axis relative to the housing to create a pattern in the media; and a second drive mechanism for driving the carriage transversely along the radial path of the rail track, the second drive mechanism including a flexible rack gear adapted to travel along the guide track, the flexible rack gear having a continuous length along the guide track which is greater than the radius r, such that the rack gear can flexibly travel through the curved portion of the guide track and provide the tool tip with a travel distance greater than the twice the radius of the circular body.

14. The system for creating a pattern as recited in claim 13, wherein the media comprises a material selected from the group consisting of fabrics, textiles, and papers.

15. The system for creating a pattern as recited in claim 13, wherein the platform provides hands-free alignment of the housing.

* * * * *